US006705713B2

(12) United States Patent
Perkins et al.

(10) Patent No.: US 6,705,713 B2
(45) Date of Patent: Mar. 16, 2004

(54) DISPOSABLE INK ASSEMBLAGE

(75) Inventors: Mark D. Perkins, Wayland, NY (US); Kenneth D. Corby, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/198,516

(22) Filed: Jul. 18, 2002

(65) Prior Publication Data

US 2004/0012659 A1 Jan. 22, 2004

(51) Int. Cl.[7] ..... B41J 2/175
(52) U.S. Cl. ..... 347/86
(58) Field of Search ..... 347/86, 7, 25, 347/49, 14, 85, 10, 19, 50, 84, 87, 23, 5, 108, 43, 20; 400/471, 208; 399/12, 13; 74/483

(56) References Cited

U.S. PATENT DOCUMENTS

| | | | | |
|---|---|---|---|---|
| 4,183,031 | A | 1/1980 | Kyser et al. | 347/86 |
| 4,506,276 | A | 3/1985 | Kyser et al. | 347/86 |
| 4,853,708 | A | 8/1989 | Walters | 347/86 |
| 4,907,019 | A | 3/1990 | Stephens | 347/86 |
| 4,961,088 | A | 10/1990 | Gilliland et al. | 399/25 |
| 5,138,344 | A | 8/1992 | Ujita | 347/86 |
| D341,157 | S | 11/1993 | Kitahara et al. | D18/56 |
| 5,266,968 | A | 11/1993 | Stephenson | 347/172 |
| 5,293,913 | A | 3/1994 | Preszler | 141/357 |
| 5,406,320 | A | 4/1995 | Durst et al. | 347/86 |
| 5,408,746 | A | 4/1995 | Thoman et al. | 29/890.1 |
| 5,410,641 | A | 4/1995 | Wakabayashi et al. | 358/1.13 |
| 5,506,611 | A | 4/1996 | Ujita et al. | 347/86 |
| 5,519,422 | A | 5/1996 | Thoman et al. | 347/49 |
| 5,530,531 | A | 6/1996 | Girard | 347/86 |
| 5,552,816 | A | 9/1996 | Oda et al. | 347/86 |
| 5,561,450 | A | 10/1996 | Brewster, Jr. et al. | 347/49 |
| 5,610,635 | A | 3/1997 | Murray et al. | 347/7 |
| 5,666,146 | A | 9/1997 | Mochizuki et al. | 347/86 |
| 5,691,753 | A | 11/1997 | Hilton | 347/85 |
| 5,710,579 | A | 1/1998 | Hahs et al. | 347/7 |
| 5,721,576 | A | 2/1998 | Barinaga | 347/85 |
| 5,745,137 | A | 4/1998 | Scheffelin et al. | 347/85 |
| 5,751,322 | A | 5/1998 | Miller et al. | 347/86 |
| 5,788,388 | A | 8/1998 | Cowger et al. | 400/703 |
| 5,825,387 | A | 10/1998 | Cowger et al. | 347/86 |
| 5,825,388 | A | 10/1998 | Sasaki | 347/86 |
| 5,835,817 | A | 11/1998 | Bullock et al. | 399/25 |
| 5,860,363 | A | 1/1999 | Childers et al. | 101/483 |
| 5,880,764 | A | 3/1999 | Barinaga | 347/86 |
| 5,920,333 | A | 7/1999 | Bates | 347/85 |
| 5,956,057 | A | 9/1999 | Childers et al. | 347/49 |
| 5,959,647 | A | 9/1999 | Claramunt et al. | 347/49 |
| 6,000,773 | A | 12/1999 | Murray et al. | 347/7 |
| 6,003,985 | A | 12/1999 | Bekki | 347/86 |

(List continued on next page.)

FOREIGN PATENT DOCUMENTS

| | | |
|---|---|---|
| DE | 3405164 A1 | 8/1985 |
| EP | 0 834 403 A2 | 4/1998 |
| EP | 1 153 751 A2 | 11/2001 |
| JP | 359-214656 | 12/1984 |
| JP | 363-004953 | 1/1988 |

*Primary Examiner*—Raquel Yvette Gordon
*Assistant Examiner*—Charles W. Stewart, Jr.
(74) *Attorney, Agent, or Firm*—Roger A. Fields

(57) ABSTRACT

A disposable ink assemblage intended for an ink cartridge includes an ink bag containing an ink supply, and an ink egress snout attached to the bag and from which the ink supply is to be discharged from the bag. The snout is configured to be received in a collar only when the collar is in any one of a number of allowable orientations, and to fix the collar relative to the snout in a selected one of the orientations in order that the fixed orientation of the collar may serve to identify the ink supply in the bag.

8 Claims, 3 Drawing Sheets

U.S. PATENT DOCUMENTS 6,019,449 A 2/2000 Bullock et al. ..... 347/14
6,059,403 A 5/2000 Burgin ..... 347/49
6,065,826 A 5/2000 Robinson et al. ..... 347/49
6,102,533 A 8/2000 Nozawa et al. ..... 347/86
6,130,695 A 10/2000 Childers et al. ..... 347/85
6,151,039 A 11/2000 Hmelar et al. ..... 347/7
6,155,678 A 12/2000 Komplin et al. ..... 347/86
6,164,743 A 12/2000 Hmelar et al. ..... 347/7
6,168,262 B1 1/2001 Clark et al. ..... 347/50
6,183,077 B1 2/2001 Hmelar et al. ..... 347/86
6,199,973 B1 3/2001 Bartolome et al. ..... 347/85
6,199,977 B1 3/2001 Komplin et al. ..... 347/86
6,203,147 B1 3/2001 Battey et al. ..... 347/86
6,209,996 B1 4/2001 Gasvoda et al. ..... 347/86
6,227,638 B1 5/2001 Childers et al. ..... 347/7
6,227,643 B1 5/2001 Purcell et al. ..... 347/19
6,227,663 B1 5/2001 Santhanam et al. ..... 347/87
6,243,116 B1 6/2001 Kotaki et al. ..... 347/86
6,416,166 B1 7/2002 Robinson et al. ..... 347/49

DISPOSABLE INK ASSEMBLAGE

CROSS REFERENCE TO RELATED APPLICATIONS

Reference is made to commonly assigned, applications Ser. No. 09/931,523, entitled INK CARTRIDGE WITH COLOR DISCRIMINATION STRUCTURE and filed Aug. 16, 2001 in the names of Trafton, Newkirk, and Robinson; Ser. No. 09/931,420, entitled INK CARTRIDGE WITH ALIGNMENT FEATURES AND METHOD OF INSERTING CARTRIDGE INTO A PRINTER RECEPTACLE and filed Aug. 16, 2001 in the names of Trafton, Newkirk, Robinson, and Gotham; Ser. No. 09/931,521, entitled INK CARTRIDGE WITH MEMORY CHIP AND METHOD OF ASSEMBLING and filed Aug. 16, 2001 in the names of Trafton, Newkirk, and Robinson; and Ser. No. 09/931,313, entitled INK CARTRIDGE WITH INTERNAL INK BAG AND METHOD OF FILLING and filed Aug. 16,2001 in the names of Trafton, Famung, and Petranek.

Reference is also made to commonly assigned, copending application Ser. No. 10/198,516 entitled INK CARTRIDGE HAVING INK IDENTIFIER ORIENTED TO PROVIDE INK IDENTIFICATION and filed on the same date as this application in the names of Perkins and Corby.

All of the cross-referenced applications are incorporated into this application.

FIELD OF THE INVENTION

The invention relates generally to a disposable ink assemblage intended for an ink cartridge, and in particular to one that includes a means for visibly identifying the ink supply such as by color or type.

BACKGROUND OF THE INVENTION

The cross-referenced applications filed Aug. 16, 2001 disclose an ink cartridge that includes a means for visibly identifying the ink supply in the cartridge such as by color or type.

The disclosed cartridge includes an ink bag containing an ink supply, an ink egress snout attached to the ink bag and from which the ink supply is discharged from the ink bag, and a split collar that receives or mates with the snout via an annular rib on the collar and an annular groove on the snout. The collar when mated with the snout can be rotated about the snout to any one of a number of allowable orientations. The particular orientation of the collar that is selected serves to identify the ink supply in the ink bag.

A pair of housing halves for the ink bag when connected together form a bottom opening for the collar. The bottom opening is bounded by multi-sided edges of the housing halves. The collar has a peripheral recess with a multi-sided floor that complements the multi-sided edges. This permits the collar when arranged in any one of the orientations to be trapped in the bottom opening to prevent rotation of the collar relative to the snout. Moreover, it serves to secure the bag to the housing halves.

SUMMARY OF THE INVENTION

A disposable ink assemblage intended for an ink cartridge and comprising an ink bag containing an ink supply, and an ink egress snout attached to the bag and from which the ink supply is to be discharged from the bag, is characterized in that:

the snout is configured to be received in a collar only when the collar is in any one of a number of allowable orientations and to fix the collar relative to the snout in a selected one of the orientations in order that the fixed orientation of the collar may serve to identify the ink supply in the bag.

DETAILED DESCRIPTION OF THE INVENTION

Figure 1:
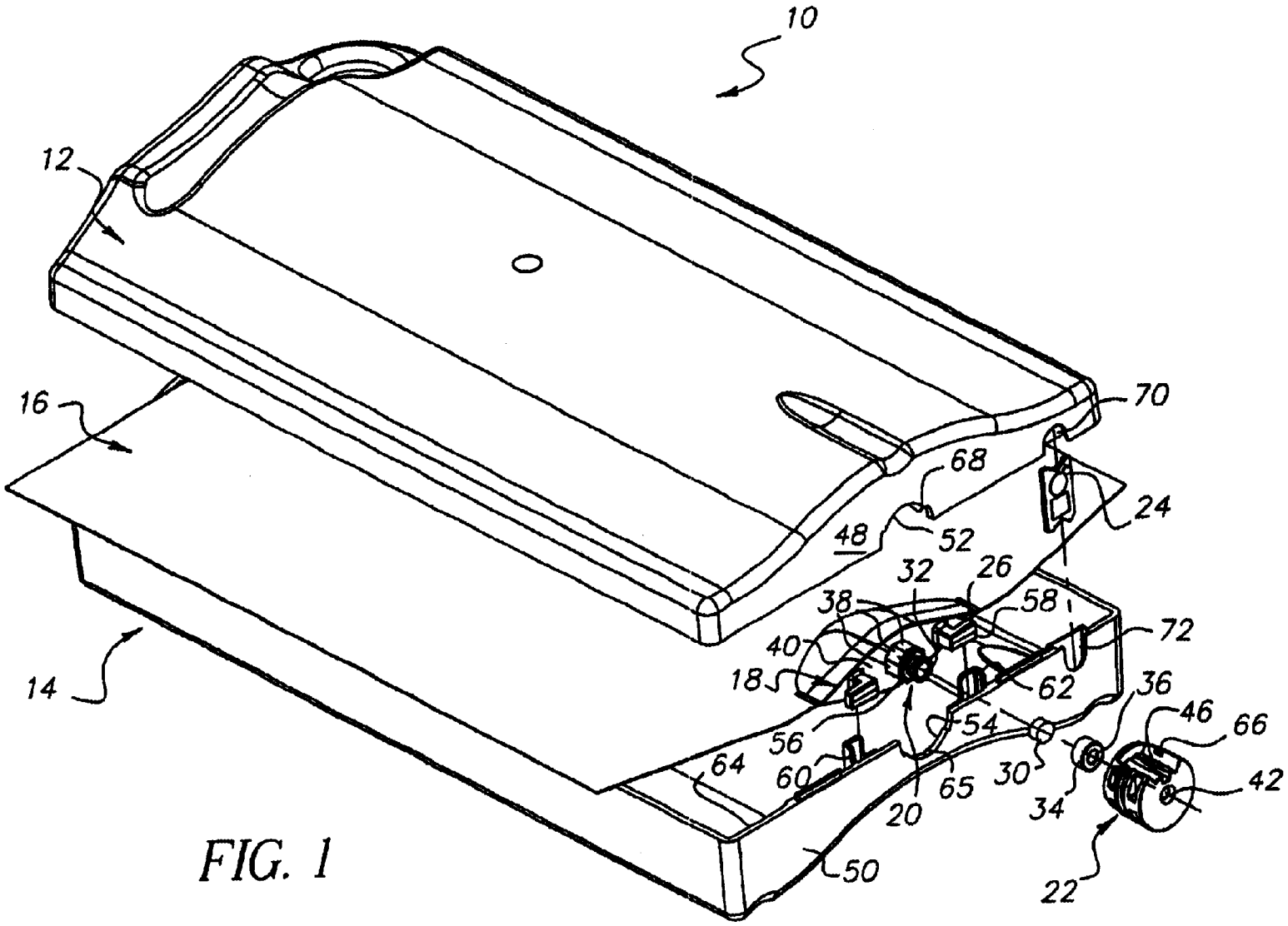
FIG. 1 is an exploded perspective view of a disposable ink assemblage in an ink cartridge, including an ink bag and an ink egress snout attached to the ink bag and configured to be received in a collar that is oriented to identify an ink supply in the bag, according to a preferred embodiment of the invention.

Referring now to the drawings, FIGS. 1–4 show an ink cartridge 10 for an ink jet printer (not shown). The cartridge includes the following components:

a pair of mating plastic housing halves 12 and 14, a disposable flexible ink supply bag 16;

a plastic connector-fitting or fitment 18 having an integral ink egress snout 20 for discharging an ink supply from the bag 16, a plastic single-part collar 22 for the snout 20, which functions as an ink identifier to identify the ink supply in the bag 16 such as by color or type; and a memory chip 24.

Figure 3:
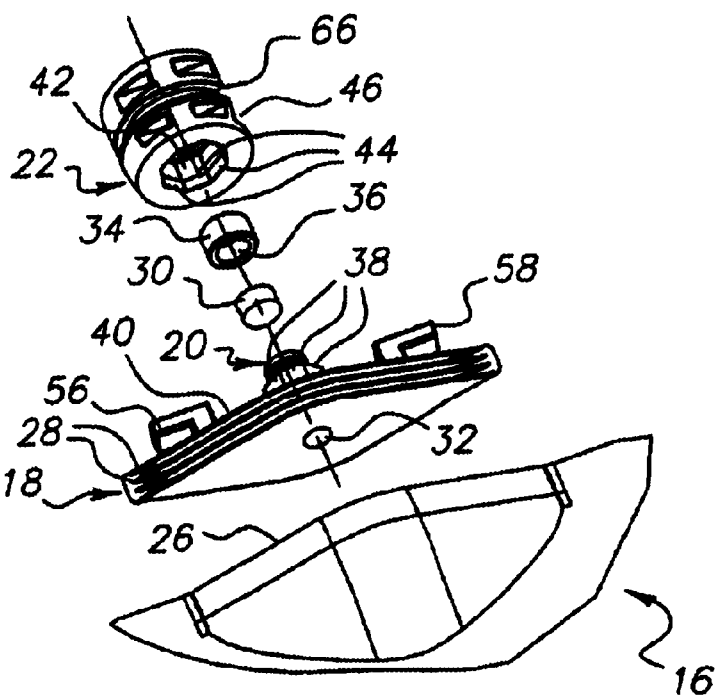
FIGS. 2 and 3 are exploded perspective views of the ink bag, the ink egress snout, and the collar as shown from opposite views.
Figure 2:
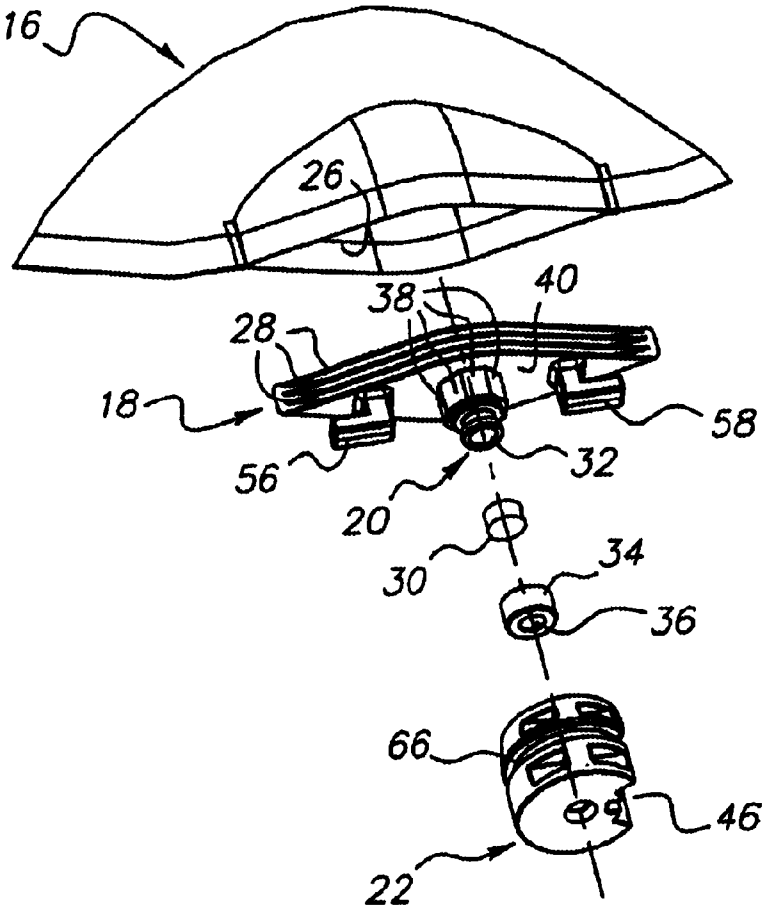

As shown in FIGS. 2 and 3, the fitting 18 is attached via a thermal seal to the bag 16, within an elongate opening 26 in the bag. During the thermal seal of the bag 16 to the fitting 18, a small amount of melted material from the bag flows between parallel ribs 28 along opposite longitudinal sides of the fitting 18 to provide an essentially leak-proof seal between the bag and the fitting. A rubber septum 30 is tightly inserted into an ink egress opening 32 in the snout 20 to plug the opening. Then, an aluminum cap 34 is press-fitted on the snout 20. The cap 34 partially overlaps the septum 30 to capture the septum, and has a center opening 36 which allows a hollow needle (not shown) to pierce the septum in order to discharge an ink supply from the bag 16 when the cartridge 10 is used in an ink jet printer.

The snout 20 has eight identical outer peripheral surfaces or facets 38 that project perpendicular from a longitudinal planar face 40 of the fitting 18 to form an octagon. See FIGS. 2 and 3. In a similar sense, the collar 22 has a center opening 42 that is circumscribed by eight identical inner peripheral surfaces or facets 44 that form an octagon. This mutual or complementary configuration allows the snout 20 to be received in the center opening 42 only when the collar 22 is in any one of eight allowable angular orientations 0° or 360°, 45°, 90°, 135°, 180°, 225°, 270°, and 315°. Preferably, the eight surfaces 44 of the collar 22 are aligned with the eight surfaces 38 of the snout 20 to position the collar relative to the snout in a selected one of the eight orientations. Then, the collar 22 is mated with the snout 20 in the selected orientation. Respective contact between the eight surfaces 38 and the eight surfaces 44 prevents the collar 22 from being rotated about the snout 22 and thus serves to fix the collar in the selected orientation. The selected orientation provides a visible indication that serves to identify the ink supply in the bag 16 such as by color or type.

As described in the cross-referenced applications filed Aug. 16, 2001 and incorporated into this application, the collar 22 has a key slot or keyway 46 that is positioned in accordance with the selected orientation of the collar. The hollow needle (not shown) for piercing the septum in order to discharge an ink supply from the bag 16 when the cartridge 10 is used in an ink jet printer is mounted on a key assembly (not shown) having a key tab intended to be received in the key slot 46. The particular orientation of the key assembly must match the selected orientation of the collar 22 in order for the key tab to be received in the key slot 46.

The number of the surfaces 38 of the snout 20 and the number of the surfaces 44 of the collar 22, need not each be eight (although they must be the same number). Preferably, the number of the surfaces 38 of the snout 20 and the number of the surfaces 44 of the collar 22 fall within the range 4–12. All that is necessary is that the number of the surfaces 38 of the snout 20 and the number of the surfaces 44 of the collar 22 form similar complementary polygons.

Figure 4:
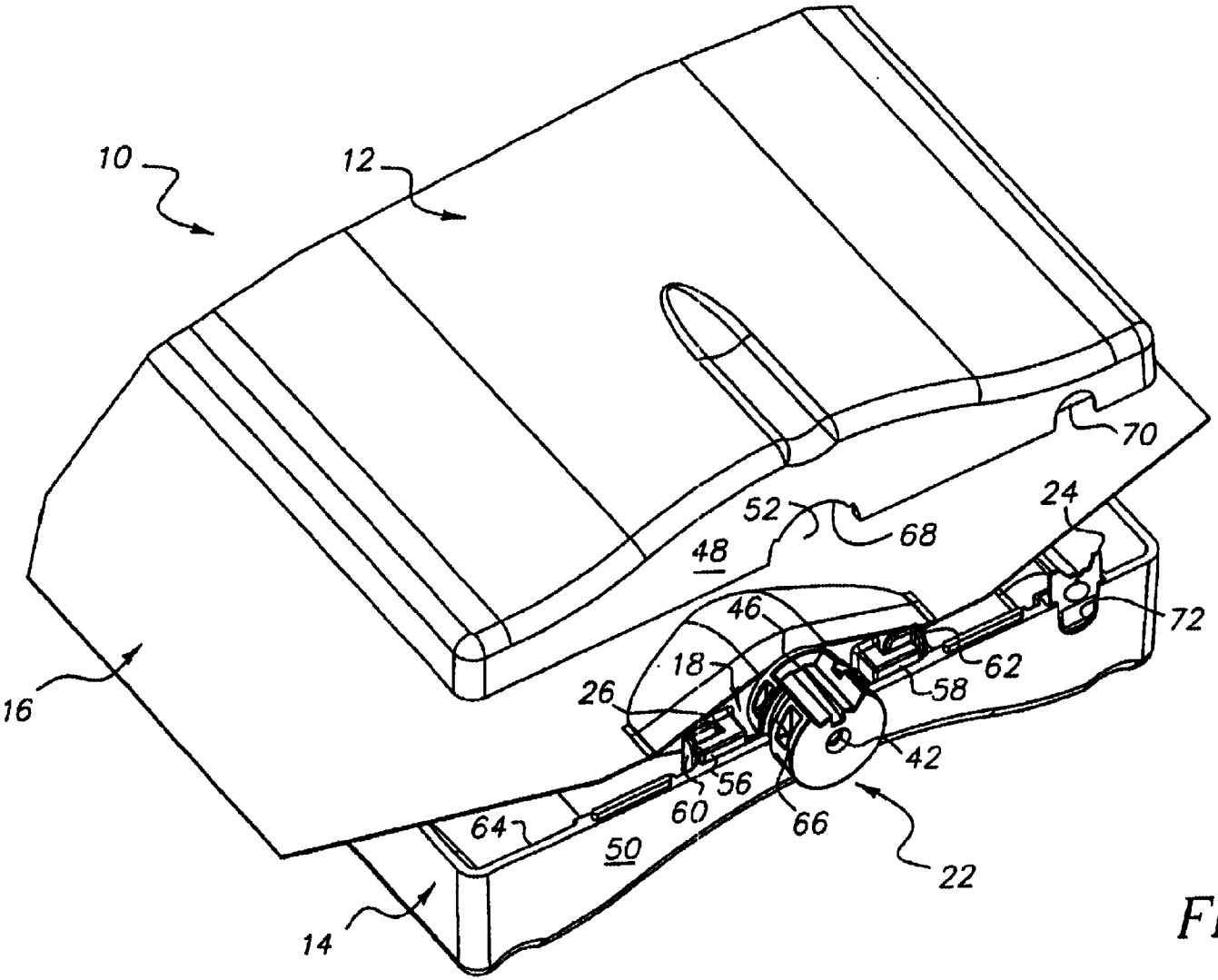
FIG. 4 is an enlargement of the ink bag and the collar as shown in FIG. 1.

The housing halves 12 and 14 at respective bottom wall portions 48 and 50 have opening halves 52 and 54 that form a bottom opening when the housing halves are connected together. See FIGS. 1 and 4. The fitting 18 has a pair of L-shaped engageable members or tabs 56 and 58 that project from respective areas of the face 40 (of the fitting) which are spaced from the snout 20. In a similar sense, a pair of L-shaped engageable members or tabs 60 and 62 project from an inner side 64 of the wall portion 50 and are spaced from the opening half 52. The L-shaped engageable members 56 and 58 extend in opposite directions as do the L-shaped engageable members 60 and 62. This complementary arrangement or mutual configuration permits the L-shaped member 56 to engage the L-shaped member 60 and the L-shaped member 58 to engage the L-shaped member 62 when the bag 16 is placed on the housing half 14. The bag 16 is thus secured in place. At the same time as shown in FIG. 4 an edge 65 of the opening half 54 is received in an outer peripheral groove 66 in the collar 22 to support the collar. Then, when the housing half 12 is connected to the housing half 14, an edge 68 of the opening half 52 is received in the groove 66.

When the bag 16 is emptied, it can be removed from the cartridge 10 and disposed of. All that is required is that the housing half 12 be disconnected from the housing half 14 and the L-shaped engageable members 56 and 58 be disengaged from the L-shaped engageable members 60 and 62. The collar 22 can be removed from the snout 20 if it is to be reused.

Other L-shaped engageable members can be provided on the fitting 18 and the housing half 14 in addition to the L-shaped engageable members 56 and 58 and the L-shaped engageable members 60 and 62. Also, it is not necessary that these engageable members be L-shaped. A number of known engagements or interlocks can be used instead, such as pins in holes, etc.

When the housing halves 12 and 14 are connected together, the memory chip 24 resides in respective opposite pockets 70 and 72 in the housing halves. See FIGS. 1 and 4.

The invention has been described in detail with particular reference to certain preferred embodiments thereof, but it will be understood that variations and modifications can be effected within the spirit and scope of the invention.

PARTS LIST

10. ink cartridge
12. housing half
14. housing half
16. ink bag
18. connector-fitting
20. snout
22. collar
24. memory chip
26. elongate opening
28. ribs
30. septum
32. ink egress opening
34. cap
36. center opening
38. eight surfaces or facets
40. face
42. center opening
44. eight surfaces or facets
46. key slot
48. bottom wall portion
50. bottom wall portion
52. opening half
54. opening half
56. L-shaped engageable member
58. L-shaped engageable member
60. L-shaped engageable member
62. L-shaped engageable member
64. inner side
65. edge
66. groove
68. edge
70. pocket
72. pocket

What is claimed is:

1. A disposable ink assemblage intended for an ink cartridge and comprising an ink bag containing an ink supply, and an ink egress snout attached to said bag and from which the ink supply is to be discharged from said bag, is characterized in that:

said snout is configured to be received in a collar only when the collar is in any one of a number of allowable orientations and to fix the collar relative to said snout in a selected one of the orientations in order that the fixed orientation of the collar may serve to identify the ink supply in said bag.

2. A disposable ink assemblage as recited in claim 1, wherein said snout has a peripheral portion in the shape of a polygon which complements a polygon within the collar in order to be configured to fix the collar relative to said snout in the selected one of the orientations.

3. A disposable ink assemblage as recited in claim 2, wherein said snout has a number of surfaces equal to the number of allowable orientations for the collar and which form said polygon on said snout.

4. A disposable ink assemblage as recited in claim 3, wherein said number of surfaces of said snout that form a polygon are within the range of 4–12 surfaces.

5. A disposable ink assemblage as recited in claim 1, wherein said snout is configured to fix the collar to prevent rotation of the collar about said snout.

6. A disposable ink assemblage intended for an ink cartridge and comprising an ink bag containing an ink supply, and an ink egress snout attached to said bag and from which the ink supply is to be discharged from said bag, is characterized in that:

said snout has multi-sided means to be received in a collar only when the collar is in any one of a number of allowable orientations, for fixing the collar relative to said snout in a selected one of the orientations in order that the fixed orientation of the collar may serve to identify the ink supply in said bag.

7. A disposable ink assemblage as recited in claim 6, wherein said multi-sided means have a number of sides equal to the number of allowable orientations for the collar.

8. A disposable ink assemblage as recited in claim 7, wherein said number of sides of said multi-sided means is 8.

* * * * *